United States Patent [19]

Dijkhuizen

[11] Patent Number: 4,896,384

[45] Date of Patent: Jan. 30, 1990

[54] DISCHARGE NOZZLE FOR THE DISCHARGE VALVE OF A WHIRLPOOL TUB

[75] Inventor: Okko K. Dijkhuizen, WE Roden, Netherlands

[73] Assignee: Ucosan B.V., Roden, Netherlands

[21] Appl. No.: 122,238

[22] Filed: Nov. 17, 1987

[30] Foreign Application Priority Data

Nov. 27, 1986 [DE] Fed. Rep. of Germany ..... 3440497

[51] Int. Cl.[4] ..... A61H 33/06

[52] U.S. Cl. ..... 4/542; 4/492; 4/490; 239/524; 239/412; 239/414

[58] Field of Search ..... 4/542, 568, 567, 492, 4/490, 543, 544; 239/524, 518, 506, 505, 412, 414, 424.5, 112, 106, 428.5; 261/DIG. 88

[56] References Cited

U.S. PATENT DOCUMENTS

| | | | |
|---|---|---|---|
| 3,217,986 | 11/1965 | Davis | 239/428.5 |
| 3,462,085 | 8/1969 | Nugarus | 239/524 |
| 4,211,368 | 7/1980 | Legros et al. | 239/428.5 |
| 4,314,670 | 2/1982 | Walsh, Jr. | 239/11 |
| 4,387,854 | 6/1983 | Dupont | 4/492 |
| 4,477,026 | 10/1984 | Lockwood | 239/428.5 |
| 4,486,907 | 12/1984 | Carter | 4/492 |
| 4,655,394 | 4/1987 | Ferrazza et al. | 239/412 |
| 4,797,958 | 1/1989 | Guzzini | 4/542 |

FOREIGN PATENT DOCUMENTS

| | | | |
|---|---|---|---|
| 2240434 | 2/1973 | Fed. Rep. of Germany . | |
| 2823253 | 5/1979 | Fed. Rep. of Germany . | |
| 8606463.0 | 12/1986 | Fed. Rep. of Germany . | |
| 302791 | 3/1955 | Switzerland . | |
| 712905 | 8/1954 | United Kingdom . | |
| 1015109 | 12/1965 | United Kingdom | 4/490 |
| 2114021 | 8/1983 | United Kingdom . | |

*Primary Examiner*—Ernest G. Cusick
*Assistant Examiner*—Edward C. Donovan
*Attorney, Agent, or Firm*—Wenderoth, Lind & Ponack

[57] ABSTRACT

The invention relates to a discharge nozzle for the discharge valve of a whirlpool tube having a water inlet duct and an air inlet duct, in which the water stream and air stream are mixed together as the result of an injector effect. In order to improve the hydropneumatic massaging effect, the water inlet duct is disposed axially and centrally with respect to the inner surface of an outer disk-shaped distribution element and is open to a radially outwardly leading circular discharge duct formed between the outer distribution element and an inner disk-shaped distribution element. The air inlet duct discharges air into a ring interstice defined between the inner distribution element and the tub wall or the valve body or valve housing of the discharge valve.

23 Claims, 3 Drawing Sheets

DISCHARGE NOZZLE FOR THE DISCHARGE VALVE OF A WHIRLPOOL TUB

BACKGROUND OF THE INVENTION

The invention relates to a discharge nozzle for the discharge valve of a whirlpool tub having a water inlet duct and an air inlet duct, wherein a water stream is mixed together with an air stream as the result of an injector effect.

SUMMARY OF THE INVENTION

The object of the present invention is to improve this type of discharge nozzle with respect to the hydropneumatic massaging effect to make it more pleasant. Moreover, fouling of the discharge nozzle due to contaminants contained in the water of the whirlpool tub such as hair, residues of personal hygiene products and the like is prevented to a degree as high as possible and the discharge nozzle may be cleaned in a relatively simple manner.

According to the invention, this object is achieved essentially by designing the water inlet duct such that it extends to a radially outwardly leading circular discharge duct which is formed between a disk-shaped distribution element and the valve body of the discharge valve and that a preferably circular air inlet duct discharges air into an intervening space defined between the disk-shaped distribution element and the valve body or the valve housing or the tub wall, said preferably circular air inlet duct being disposed radially outwardly of and connected to or integral with the discharge duct.

A general ringlike venturi effect is provided by the invention, since the air supplied is subject to suction along the entire circumference of the nozzle unit and is mixed with the water jet. In the process, the water/air mixture is directed to all sides substantially parallel to the tub wall extending preferably at the bottom of the tub, so that the jet does not strike the user directly. Rather, tiny air bubbles ripple upward from the intensive water/air mixture directed substantially parallel to the tub wall, resulting in a pleasant hydropneumatic massaging effect.

According to one specific embodiment of the invention, the water inlet duct is disposed axially and centrally with respect to the inner surface of the disk-shaped distribution element and is open to the circular discharge duct, which is formed between an outer disk-shaped distribution element and an inner disk-shaped distribution element disposed therebelow. The air inlet duct discharges air into an annulus defined between the inner distribution element and the tub wall or the valve body or the valve housing. By virtue of the novel arrangement of an outer and an inner distribution element, a particularly high suction effect of the air supplied is achieved along the entire circumference of the nozzle unit and the injector effect is increased at the same time.

Preferably, the air inlet duct is a ringlike space surrounding the central water inlet duct, said ringlike space open to the annulus defined between the inner distribution element and the tub wall or valve body or valve housing. In this way, an air discharge that is as uniform as possible is facilitated, and thus, a uniform water/air mixture, along the entire circumference of the nozzle unit, is achieved.

The injector effect of the discharge nozzle embodying the invention can be improved further by providing, centrally from the inner surface of the outer distribution element, a conical or similarly shaped projection that points axially toward the water inlet duct. The water jet emerging axially from the water inlet duct is thus radially deflected to all sides in a uniform and effective manner in order to impart suction to the air introduced into the annulus beneath the inner distribution element upon its exiting through the circular discharge duct.

In another embodiment of the invention, outer and inner distribution elements are joined by radial ribs that divide the circular discharge duct into individual radial discharge ducts. Thus, the ribs have not only a joining function, but also a guiding function for the outwardly directed water jet in the circular discharge duct. They also facilitate the uniform distribution of the water jet along the entire circumference of the nozzle.

The ribs may terminate inwardly of the outer edge of the outer distribution element and/or of the inner distribution element in order to allow sufficient space for the water jet to emerge from the nozzle unit.

Preferably, the height of the circular discharge duct or the individual discharge ducts formed therefrom decreases in a radially outward direction, so that the water jet in the discharge duct achieves the outlet velocity necessary for providing the injector effect.

In order to direct the water jet and the water/air mixture in a direction that is substantially parallel to the tub wall or slightly inclined thereto, the inner surface of the outer distribution element, with the exception of the central projection, may be slightly inclined toward the tub wall or may extend substantially parallel thereto.

So that the water jet emerging axially from the water inlet duct is deflected as noiselessly as possible, in still another embodiment of the invention, the surface of the central conical or quasi-conical projection is curved, or in some cases trough-shaped, and defines a transition section extending to the outer section of the inner surface of the outer distribution element.

For the discharge of the water/air mixture in a desired direction, the outer surface of the inner distribution element, with the exception of a central passageway, may advantageously extend radially outward, slightly inclined and toward the tub wall or substantially parallel thereto.

A suitable, uniform air supply at the outer edge of the nozzle unit is preferably achieved by arranging the inner surface of the inner distribution element substantially parallel to the tub wall or only slightly inclined thereto.

A specifical feature of the invention is that the inner distribution element has a smaller diameter than the outer distribution element. Thus, the outer distribution element projects beyond the inner distribution element, so that the injector effect, caused by the meeting of a radial water jet and a radial air jet, can develop largely undisturbed by the tub contents.

The injector is further improved by disposing at the edges of the outer surface of the inner distribution element (or at the edges of the inner surface of the outer distribution element) a beadlike projection, which produces a narrowing of the ringlike space defined between the outer and inner distribution elements.

Preferably, the two distribution elements, including the ribs, if provided, are made from one piece of plastic or rubber. This simplifies not only the manufacture and assembly, but also, if the nozzle is designed as flat as possible, the discomfort of a user of the tub when sitting on the bottom of the tub is minimized, since plastics and rubber possess low thermal conduction coefficients and therefore do not feel "cold". Furthermore, at least the outer surfaces can be flexible so that sitting on the bottom of the tub provided with the novel outlet will be comfortable. The buoyancy forces to which the human body is subjected when immersed in water also are a contributory factory.

It is also possible to make the inner distribution element as an upper, radial rim extension of the wall section of the valve body between the central water inlet duct and the air inlet duct surrounding the latter. In some cases, the valve body, inner distribution element, radial ribs and outer distribution body may also be unitary.

In this case, the valve body advantageously extends above the valve housing of the discharge valve with a circumferential flange and the annulus for the air discharge formed between the inner distribution element and the circumferential flange.

The surface of the circumferential flange of the valve body may slope downwardly in a radially outwardly direction toward the tub wall, so that the discharge slot for the water/air mixture flares radially outwardly in order to impart a flow rate to the mixture that feels pleasant.

The one-piece nozzle unit consisting of an outer distribution element, inner distribution element, and the radial ribs joining both elements can be detachably mounted to the valve body by, for example, a bayonet joint, threaded joint, suction joint, or plug-type connector or magnetic lock, or (as mentioned earlier) they may be integral with the valve body.

According to yet another embodiment of the invention, the water inlet duct in the area of the discharge duct has radially arranged outlet openings. In this embodiment, the deflection of the axially supplied water occurs in the inlet duct, so that it can flow uniformly from all sides through the discharge duct in order to subject the air introduced into the intervening space to a suction effect upon being discharged.

In order that the parts of the discharge nozzle projecting into the whirlpool tub may have a low installation height and fit snugly against the bottom wall of the whirlpool tub, thus enabling the user to sit comfortably, it has proved to be particularly advantageous if the valve body, in the area of the discharge duct, has an axial extension with a locking groove for attaching the distribution element which in some cases is made from flexible material.

The injector effect of the discharge nozzle incorporating the invention is improved further by designing the inner surface of the disk-shaped distribution element, forming a radial discharge slot at the edges of the discharge duct, to extend in a radially outward direction, slightly upwardly with respect to the tub wall. This will impart a discharge velocity to the water jet that is necessary for achieving for a satisfactory injector effect.

If the air inlet duct discharges air into the intervening space directly behind the discharge slot, a particularly large suction effect of the water jet emerging from the discharge slot will be achieved.

In order to impart to direct the water/air mixture substantially parallel to the tub wall or slightly inclined and away therefrom, the inner surface of the disk-shaped distribution element can, in the intervening space open to the discharge duct, extend slightly inclined or substantially parallel to the tub wall.

In order to subject the air introduced into the intervening space to a very large suction effect, a further embodiment of the invention provides that the inner surface of the disk-shaped distribution element, in an area of transition defined from the outlet duct to the radially outwardly connecting intervening space, forms a venturi throat with the opposing parts of the discharge valve.

To impart the greatest possible discharge velocity to the water jet emerging from the discharge duct, the surface of the valve body is inclined toward the tub wall from a radially outward location.

To enable the water/air mixture to flow as uniformly as possible through the intervening space, the surface of the valve body in the intervening space advantageously extends substantially parallel to the inner surface of the distribution element, whereby in some cases the height of the intervening space is slightly greater than the width of the discharge slot. This also counteracts the generation of noise of the water/air mixture emerging from the discharge nozzle embodying the invention.

It is likewise within the scope of the invention, if the surfaces defining, along with the inner surface of the distribution element, the discharge duct and/or the intervening space, are formed by at least one axially moving piston that surrounds the water inlet duct substantially concentrically, said piston being movable to a closed position to seal the water inlet duct and/or the air inlet duct against liquid and/or gas. In this way, contaminants found in the water of the whirlpool tub, such as hair, dirt particles or the like, cannot accumulate in the discharge nozzle which would normally tend to impair or even clog the discharge nozzle. While the piston(s) is or are in the open position, the piston surfaces define, along with the inner surface of the distribution element, the discharge duct and the intervening space disposed radially outwardly and open thereto. The piston or pistons, upon disconnecting the discharge nozzle, move substantially axially to the inner surface of the distribution element, to a closed position so as to ensure a liquid-tight closing of, for example, the water inlet duct and/or the air inlet duct.

Advantageously, at least one piston in the valve body or on the valve housing or on the tub wall is guided axially during the axial upward movement of said at least one piston in the valve body or on the valve housing or on the tub wall.

Advantageously, the air inlet duct is divided into radially arranged individual air inlet ducts, which are in communication with axially extending bores in the piston.

For facilitating a uniform introduction of air into the intervening space, the bores in one embodiment of the invention may be open to an annular duct that discharges air into the intervening space.

To achieve a suction effect for the air supplied, the bores or the annular duct discharge or discharges air into the intervening space directly behind the discharge slot.

Another provision of the invention is that the surfaces of the distribution element and of the piston that abut each other in the closed position of the piston, and in particular, at least the sections of the surfaces of the piston abutting against the inner surface of the distribution element, are closing surfaces or, as desired, have a flexible coating or a bearing surface or liner made of rubber or the like. Aside from adequately sealing the interior of the discharge valve against the passage of water containing contaminants, the mechanical strains and stresses of the surfaces abutting each other in the closed position of the piston are reduced, thereby ensuring a long service life of the discharge valve according to the invention.

According to one aspect of this inventive concept, a provision is made that, in the open position of the piston, the surfaces thereof extending to the bores or on either side of the discharge slot are staggered, whereby the piston surface forming, along with the inner surface of the distribution element, the intervening space recedes axially and the piston wall closed off from the surface associated with the discharge duct has, in the area of the discharge duct or of the air inlet duct or of the bores, a recess over which a sealing strip of flexible material extends in the open position of the piston. The recess may define the discharge slot extending in substantially tangential direction to the piston surface. The strip is pressed into the recess in the closed position of the piston. This advantageous embodiment of the invention requires only one lifting cylinder with bores and at the same time, the height of the intervening space can be larger than the width of the discharge slot thereby facilitating a uniform flow of the water/air mixture, as well as contributing to a low noise generation. In order to enable the closing of the discharge duct by the lifting motion of a piston, the recess is provided in the piston wall below the piston surface associated with the intervening space and the imaginary line extending tangentially inwardly therealong over the air inlet duct or the bores in the piston. The front section of the sealing strip extending above the recess and forming, along with the inner surface of the distribution element, the discharge slot is pressed into the recess in the closed position, resulting in a bead of the flexible sealing strip being formed along the inner surface of the distribution element.

For automatically opening and closing the discharge valve of the invention, the piston can be moved from the closed position to the open position against the force or the pressure of the water emerging from the water inlet duct.

Advantageously, a spring force accumulator is formed by springs, rubber cushions, or the like, which are arranged in an annulus that surrounds the water inlet duct substantially concentrically and which are disposed between the piston and a bearing surface of the valve body. Thus, no external drive is required for providing the up-and-down motion of the piston. Rather, the discharge valve incorporating the invention is opened in a simple fashion by the pressure of the water emerging from the outlet openings of the valve body, while, during the shut-off of the water supply, the discharge duct and/or the intervening space are/is closed automatically by the restoring force of the spring or of the rubber cushion against the passage of liquid or gas.

It is also within the scope of the invention that the annulus provided in the valve body be formed with a wall section extending axially upwardly from the bearing surface to receive the piston mounted on the springs, the rubber cushions, or the like, whereby the inner wall section of the piston with the opposing wall section of the valve body arranged concentrically to the water inlet duct forms a ring interstice. The annulus is open to an axially downwardly extending return duct in the valve body, said return duct being connected to the drain of the whirlpool tub, in some cases by means of a shut-off device. Thus, cleaning of the cleaning nozzle of the invention is achieved in an advantageous manner by injecting a cleansing liquid into the interstice during an off state of the discharge nozzle in which the discharge duct is sealed against the passage of water and, in some cases, air. Therefore, the cleaning liquid flows via the ring interstice to the annulus provided in the valve body and flows from there via a return duct to the drain of the whirlpool tub. The pressure of the cleaning liquid issuing from the outlet openings of the water inlet duct must be such that the piston remains in its closed position. This results in an efficient backflushing or cleaning of the discharge nozzle of the invention.

The invention also provides that on either side of the bores or of the air inlet duct or individual air inlet ducts provided in the valve body there are ringlike rubber cushions that surround the water inlet duct concentrically. In at least the closed position of the piston, the cushions maintain the annulus between the piston and the bearing surface and divide it into two sections that are sealed from each other, the cushions being impervious to liquid or gas, whereby the radially outer section is axially upwardly in communication with the bores and axially downwardly with the air inlet duct or individual air inlet ducts. This embodiment entails a very simple design, may be manufactured at a relatively low cost, and does not require special means for placing the air inlet duct or individual air inlet ducts extending axially upwardly in the valve body in communication with the bores in the piston.

Advantageously, the ring interstice has a width of 0.1 to 1 mm, preferably 0.6 mm, corresponding to approximately half that of the discharge slot, so that in the open position of the piston, even without a shut-off device between return duct and discharge of the whirlpool tub, only a small amount of the water introduced into the water inlet duct leaks into the interstice during the operation of the discharge nozzle.

The distribution element may be connected by a bayonet joint, threaded joint, suction joint, plug-in connector or magnetic lock to the valve body that may have an axial extension, or that may be integral therewith.

Within the scope of the invention, it is possible, aside from the injector effect described above, to control the water supply and/or air supply, preferably so as to effect a pulsating action, so as to further increase the hydropneumatic massaging effect.

BRIEF DESCRIPTION OF THE DRAWINGS

Further objects, features, advantages and applications of the present invention will become apparent from the ensuing description of embodiments thereof with reference to the accompanying drawing. In the drawings

DETAILED DESCRIPTION OF THE PREFERRED EMBODIMENTS

Figure 1:
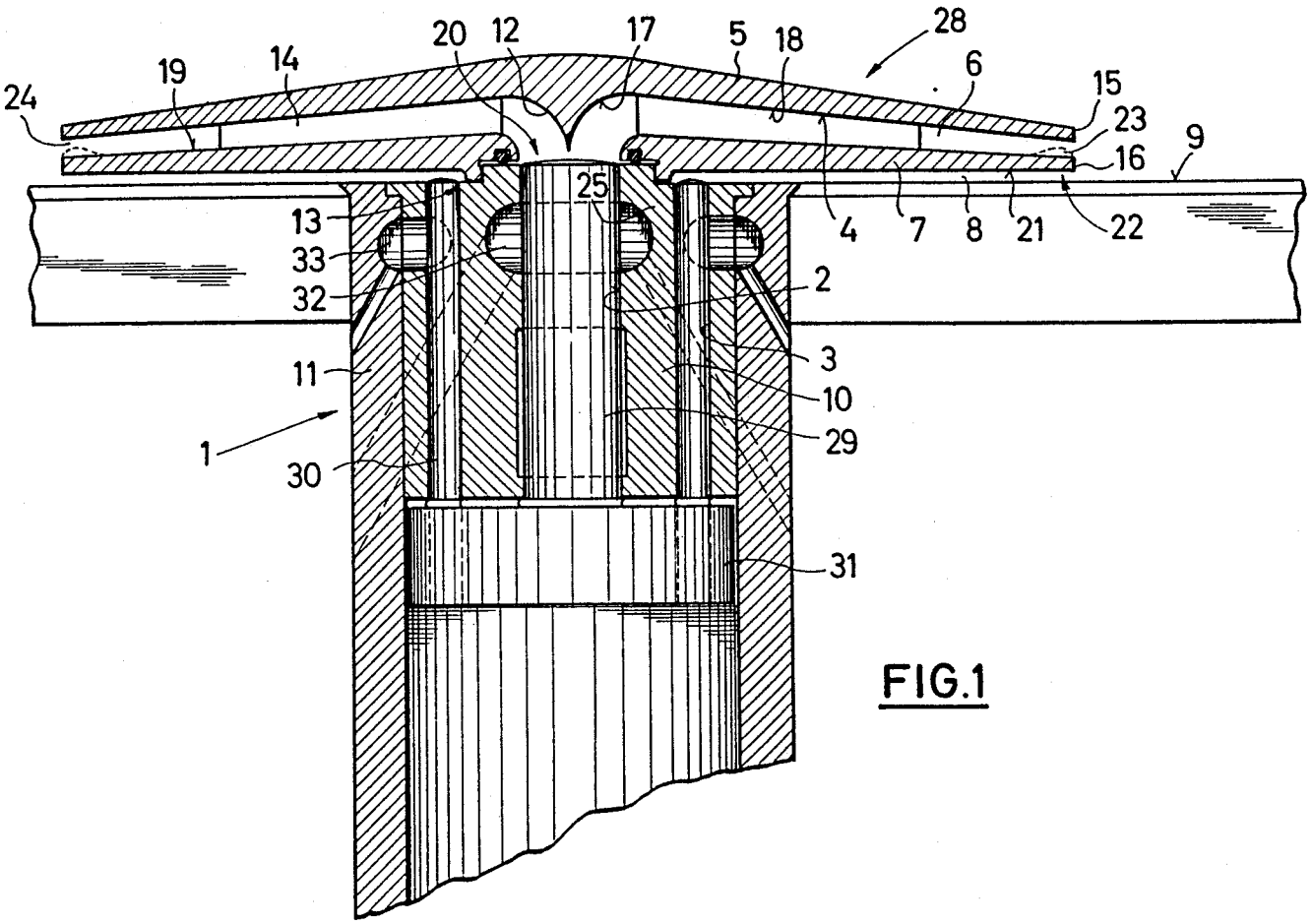
FIG. 1 shows schematically and in section a discharge nozzle according to the present invention.

The discharge nozzles shown are located at the discharge valve 1 of a whirlpool tub. The discharge valve 1 has a water inlet duct 2 and an air inlet duct 3 which, upon actuation of a piston 31 by axial movement of a closure unit 29 and a shut-off device 30, are supplied with water and air via distribution chambers 32, 33. The water inlet duct 2 is axially and centrally disposed with respect to the inner surface 4 of an outer disk-shaped distribution element 28 which is contiguous to a radially outwardly extending circular discharge duct 6, the inner surface 4 and discharge duct 6 defined between an outer distribution element 5 and an inner disk-shaped distribution element 7. The air inlet duct 3 surrounding the central water inlet duct 2 in a ringlike fashion or the individual air inlet ducts disposed along the circumference of and spaced from the central water inlet duct discharges or discharge air into a ring interstice 8, which extends radially between the inner distribution element 7 and the tub wall 9 or the valve body 10 or the valve housing 11 of the discharge valve 1. The air inlet duct 3 thus defines a ringlike discharge slot 13, which opens into the ring interstice 8. Centrally from the inner surface 4 of the outer distribution element 5, a conical or similarly shaped projection 12 extends in a extends in a direction toward the water inlet duct 2. The latter serves to deflect the incoming water jet in a radial direction. The outer distribution element 5 and the inner distribution element 7 are joined via radial ribs 14 which divide the circular discharge duct 6 into individual, radial discharge ducts and ensure that the water supply is uniform in all directions, starting from projection 12. The ribs 14 may terminate inwardly of the outer edge 15 or 16 of the outer distribution element 5 and/or of the inner distribution element 7, so that there is sufficient space for the water to emerge at the outer edge of the nozzle unit 28 which is made up of the outer distribution element 5 and the inner distribution element 7. The height of the circular discharge duct 6 or of the individual discharge ducts decreases in a radially outward direction in order to impart the desired discharge velocity to the water jet to ensure an adequate injector effect. The inner surface 4 of the outer distribution element 5, with the exception of the central projection 12, extends obliquely to the tub wall 9. Likewise, the outer surface 19 of the inner distribution element 7, with the exception of a central passageway 20, extends obliquely to the tub wall 9. Thus, the cross section of the discharge duct 6 has a predetermined taper in a radially outward direction. The surface of the projection 12 is curved (FIG. 1), or trough-like (FIG. 2), at transition area 17 which is contiguous to the outer portion 18 of the inner surface 4 of the outer distribution element 5. The curved transition section 17 has a diameter that does not exceed substantially the diameter of the water inlet duct 2, while the trough-like transition area 17 of FIG. 2 is disposed at the middle of the inner distribution element 7 in order to increase the injector effect of the water jet.

The inner surface 21 of the inner distribution element 7 extends substantially parallel to the tub wall 9 (FIG. 1) or is inclined thereto (FIG. 2) so as to contribute to the uniformity of the air supply encountering the water jet. While in the specific embodiment depicted in FIG. 1 the two distribution elements 5 and 7 have essentially the same cross section, the inner distribution element 7 of the embodiment shown in FIG. 2 has a smaller cross section than the outer distribution element 5, so that the ringlike injector effect occurring when the emerging water jet encounters the air jet can occur beneath the outer edge of the outer distribution element 5.

As indicated by the dashed line in FIG. 1, in order to further enhance the injector effect, there may be provided at the edges 22 of the outer surface 19 of the inner distribution element 7 (and/or at the edges of the inner surface 4 of the outer distribution element 5) beadlike projection 23 which produces a narrowing of the ringlike discharge slot 24 defined between the outer and inner distribution elements 5 and 7.

Figure 2:
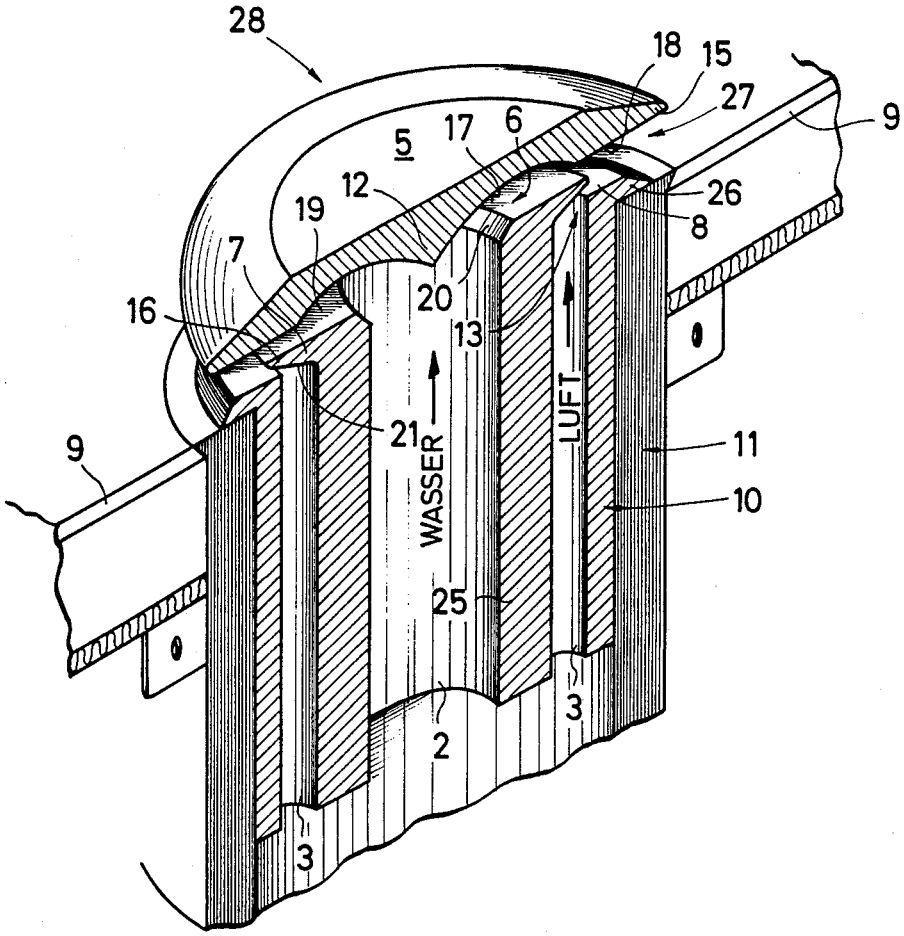
FIG. 2 is a perspective view, likewise in section, of another embodiment of the discharge nozzle of the invention.

As shown in FIG. 2, the two distribution elements 5 and 7, including the ribs 14, are made of one piece from plastics or rubber.

In the embodiment shown in FIG. 2, the inner distribution element 7 is formed by an upper, radial extension of the wall section 25 of the valve body 10 extending from the central water inlet duct 2 and over the air inlet duct 3 surrounding the latter. Accordingly, valve body 10, inner distribution element 7, ribs 14, and outer distribution element 5 are unitary. The valve body 10 is suspended from the valve housing 11 of the discharge valve 1 via a circumferential flange 26, thereby forming the ring interstice 8 for facilitating the air discharge between the inner distribution element 7 and the circumferential flange 26. The surface of the circumferential flange 26 of the valve body 10 may, as is also apparent from FIG. 2, extend radially outwardly and obliquely to the tub wall 9, so that the discharge slot 27 for the water/air mixture flares radially outwardly (subsequent to the injector effect).

As apparent from FIG. 1, the one-piece nozzle unit 28 consisting of outer distribution element 5, inner distribution element 7 and the radial ribs 14 joining them is sealingly attached to an appropriate projection of the valve body 10. However, other detachable joints such as a bayonet joint, threaded joint, suction joint or magnetic lock may also be employed if the valve body 10 is not integral with the nozzle unit, as illustrated in FIG. 2.

The water and/or air supply to the discharge nozzle embodying the invention can be adjustably controlled, preferably pulsated. To do this, the piston 31, for example, can be actuated accordingly.

Figure 3:
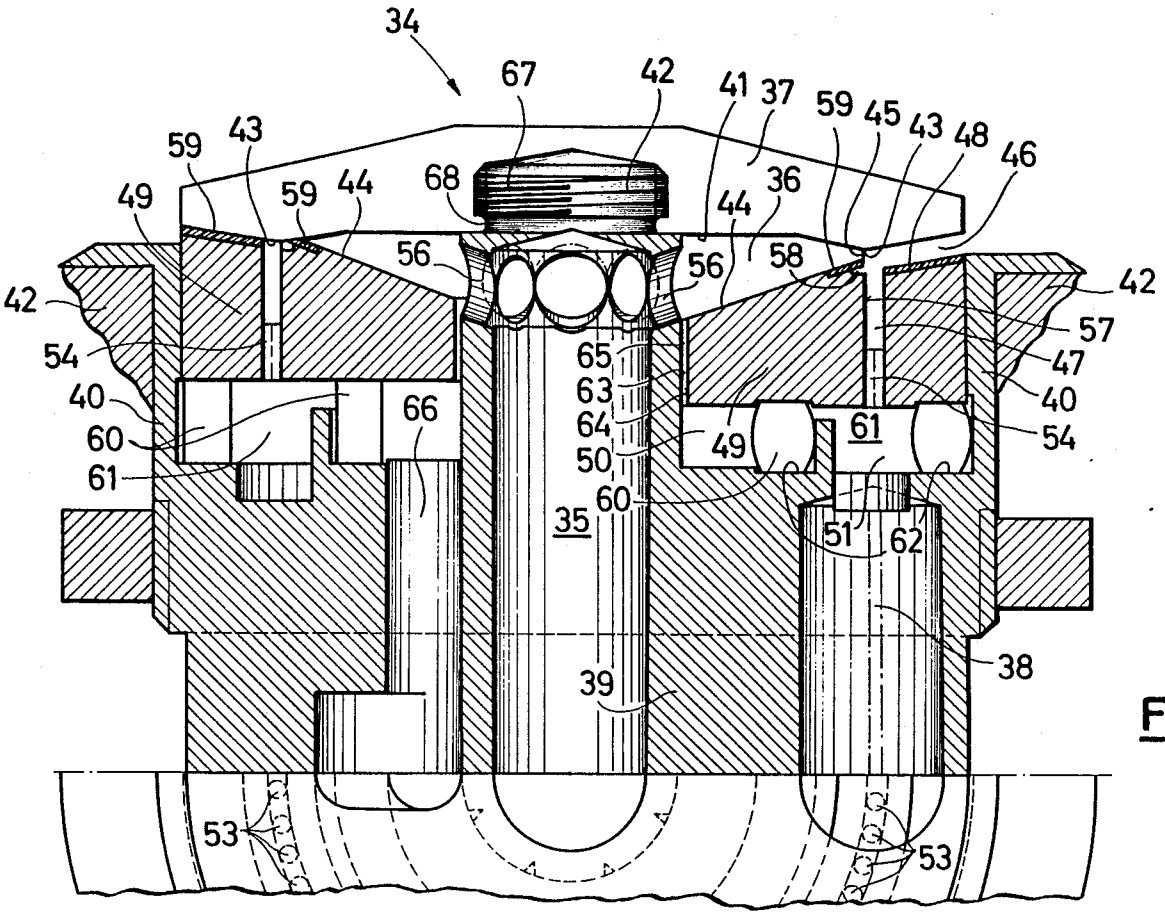
FIG. 3 shows schematically and in section another embodiment of a discharge nozzle of the invention, with a locking mechanism and a backflushing system.

The discharge nozzle shown in FIG. 3 for the discharge valve 34 of a whirlpool tub has a valve body 39 with a centrally arranged water inlet duct 35, which is provided with an outlet opening 56 for discharging water radially into a discharge duct 36. The discharge duct 36 is formed by the inner surface 41 of a disk-shaped distribution element 37, that can be attached to an extension 67 of the valve body 39 provided with a locking groove 68, and by a surface section 44 of a piston 49. In this embodiment, the height of the discharge duct 36 decreases in a radially outward direction, because the surface 44 of the piston 49 extends in a radially outward direction obliquely to the tub wall 42 and the inner surface 41 of the disk-shaped distribution element 37 includes an inner section extending substantially parallel to the tub wall 42 and a section inclined obliquely thereto, thereby forming a discharge slot 45 at the circumference of the discharge duct 36, which is directed radially outwardly. Through this discharge duct 36 tapering radially outwardly the water emerging from the outlet openings 56 is given the necessary velocity in order to create, upon the issuing thereof from the discharge slot 45, a suction effect on the air introduced directly behind the discharge slot 45 via an air inlet duct 38 extending upwardly in the valve body 39 and, in some cases, via individual air inlet ducts 53 in communication therewith. The mixing of the water with the sucked air occurs in an intervening space 46 open to and defined radially outwardly of the discharge duct 36. This intervening space 46 is formed by the outer edges of the inner surface 41 of the disk-shaped distribution element 37 and a section 48 of the surface of piston 49. In order to impart to the water/air mixture a desired direction of discharge, the intervening space 46 having an annular shape extends in a direction away from the tub wall 42. To mix the water well with the air being supplied, the intervening space 46 is provided with a constant width which exceeds the width of the discharge slot 45 by a factor of 2 in the preferred embodiment.

The piston 49 having the surfaces 44 and 48 is disposed in an annulus 61 of the valve body 39 defined by an axial wall section 63 concentrically surrounding the water inlet duct 35 and a radially outwardly extending bearing surface 62. For facilitating the axial lifting motion of the piston 49 along the valve housing 40 of the discharge valve 34, there are provided spring force accumulators in the form of rubber cushions 60 on which the piston 49 is mounted and which is supported by the bearing surface 62 of the annulus 61. As can be seen in FIG. 3, the two ringlike rubber cushions 60 concentrically surrounding the water inlet duct 35 are arranged on either side of the bores 54 extending axially upwardly into an annular duct 47, or on either side of the air inlet duct 38 or individual air inlet ducts 53. This symmetrical arrangement prevents, on the one hand, the piston 49 from tilting during its lifting motion, while, on the other hand, defines an intervening space of the annulus 61 between piston 44 and bearing surface 62 of the valve body. This intervening space is divided by the rubber cushions 60 into two sections 50 and 51 separated from each other and impervious to liquid and/or gas, whereby the radially outer section 51 for the passage of air is in communication with the bores 54 of the piston 49 and with the air inlet duct 38 or individual air inlet ducts 53. The restoring force of the rubber cushions 60 is selected so that during operation of the discharge valve 34, the piston 49 with its surface 44 and 48 is urged axially downwardly to an open position as a result of the pressure of the water exiting through the outlet openings 56 and aided by the pressure of the water/air mixture formed in the intervening space 46. If, however, the discharge valve 34 is switched off, then the restoring force of the rubber cushions 60 produces an axial lifting motion of the piston 49, during which the terminal section of its surface 44 and its surface 48 are urged against the inner surface 41 of the disk-shaped distribution element 37, thereby sealing the discharge valve 34 against the water in the whirlpool tub. To ensure reliable sealing and at the same time reduce mechanical strains and stresses, the sections of the piston surfaces 44 and 48 that abut against the inner surface 41 of the diskshaped distribution element 37 while the piston 49 is in its closed position are provided with a sealing strip 59. In the axially moving piston described herein, in which a width of the intervening space 46 exceeds the width of the discharge slot 45, the piston 49 has directly under the discharge slot 45 and adjacent to the air inlet 54 a recess which, in the open position, is located below the sealing strip 59 to define the underside of the discharge slot 45. In the closed position, the sealing strip 59 is urged into the recess 58, whereby a bead of the sealing strip 59 is formed at the edge of the recess 58, the bead firmly pressed against the inner surface 41 of the disk-shaped distribution element 37, thereby sealing the interior of the discharge duct 36 against the passage of liquid.

This sealing of the discharge duct 36, not only from the surroundings of the discharge valve 34, but also from the bores 54 for the air being supplied, is of particular advantage for facilitating the novel backflushing or cleaning of the discharge valve 34. To this end, there is provided between the inner wall section 64 of the piston and the wall section 63 of the valve body 39 confronting the inner wall section 64, a ring interstice 65 connecting the discharge duct 36 and the section 50 and maintained open by the rubber cushions 60. The section 50 of the annulus is open to a return duct 66 extending in the valve body 39 axially downwardly and connected, as desired, via a shut-off device, to the drain of the whirlpool tub. The radially inner ringlike rubber cushion 60, again, seals the radially inner section 50 of the intervening space 61 from air supply section 51 disposed radially outwardly thereof so as to prevent the passage of water or cleansing liquid into the air supply system. The pressure of the cleansing liquid fed via the water inlet duct 35 and entering the discharge duct 36 via the outlet openings 56 is to be adjusted so that the piston 49 remains in its closed position. In order to prevent any water from flowing into the whirlpool drain via the ring interstice 65 when the piston 49 is in its open position, it is possible to provide the return duct 66 connected to the whirlpool drain with a shut-off device, which closes automatically when the water pressure is that required for moving the piston 49 to the open position, but which is open if the cleansing liquid is at a lower pressure. Alternatively, however, even without the arrangement of such a shut-off device, the rate at which the water being fed would leak into the drain can be kept to a sufficiently low level if the ring interstice 65 has a width of 0.1 to 1 mm, preferably 0.6 mm.

The discharge nozzle embodying the invention provides a completely new massaging effect by the use of an intensive water/air mixture that flows substantially parallel to the tub wall and from which tiny air bubbles move upward in the tub water. At the same time, the novel discharge nozzle permits, during its shutdown, an automatic sealing of its interior against the water of the whirlpool bath which may contain many impurities, which otherwise could lead to the clogging of the feed system. Moreover, during shutdown, the system can be backflushed advantageously with water or with a cleansing liquid without allowing the latter to enter the whirlpool bath.

I claim:

1. A discharge nozzle of an outlet valve of a whirlpool tub, said nozzle comprising:

a valve body having a water duct and an air duct defined therein;

a solid disk-shaped distribution element extending over said valve body.

said disk-shaped distribution element having an inner surface facing said valve body and between which inner surface and valve body a circular discharge duct and a circular intervening space are defined, said circular intervening space defined radially outwardly of said circular discharge duct, the water duct of said valve body open to said circular discharge duct in a manner in which water is radially discharged from said discharge duct, and the air duct of said valve open to said circular intervening space;

a piston confronting said disk-shaped distribution element, located concentrically with respect to the water duct of said valve body and slidably mounted in the nozzle so as to be slidable in the nozzle relative to said valve body toward and away from said disk-shaped distribution element, said piston having an outer surface facing the inner surface of said disk-shaped distribution element, of said circular intervening space and said circular discharge duct, at least said circular discharge duct defined between the outer surface of said piston and the inner surface of said disk-shaped distribution element, and said piston being movable to a closed position at which said piston contacts said disk-shaped distribution element and, of said water duct nd said air duct, at least said water duct being sealed by the contact between said piston and said disk-shaped distribution element.

2. A discharge nozzle as claimed in claim 1, wherein said valve body has means for guiding said piston during movement thereof toward and away from said disk-shaped distribution element.

3. A discharge nozzle as claimed in claim 1, wherein said piston has a plurality of bores extending therein and in open communication with said circular intervening space, and the air duct of said valve body includes a plurality of air passgeways that are in open communication with said bores.

4. A discharge nozzle as claimed in claim 3, wherein said piston has an annular duct extending therein between and open to said plurality of bores and said circular intervening space.

5. A discharge nozzle as claimed in claim 4, wherein the outer surface of said piston is disposed adjacent the inner surface of said disk-shaped distribution duct and said circular intervening space so s to define a discharge slot thereat, and said annular duct is open to said circular intervening space at a location immediately adjacent said discharge slot.

6. A discharge nozzle as claimed in claim 1, wherein the outer surface of said piston includes a first section which contacts said disk-shaped distribution element when said piston is in the closed position, said section being one of a bearing surface of said piston, a coating of flexible material disposed over a portion of said piston, and a rubber liner attached to a portion of the piston.

7. A discharge nozzle as claimed in claim 6, wherein the outer surface of said piston includes a second section spaced from said first section, the inner surface of said disk-shaped distribution element includes a first section which is disposed over and contacts the first section of the outer surface of the piston when the piston is in the closed position, and a second section which extends from the first section of said inner surface in a direction away from said piston and opposes the second section of the outer surface of said piston, and the second section of the outer surface of said piston including a strip of sealing material below which a recess is defined in the piston, said strip of sealing material extending in said recess and contacting said disk-shaped distribution element when said piston is in the closed position.

8. A discharge nozzle as claimed in claim 1, and further comprising spring means operatively engaging said piston and urging said piston to the closed position.

9. A discharge nozzle as claimed in claim 8, wherein said valve body includes a bearing surface, and said spring means are one of springs and rubber cushions extending between said bearing surface and said piston and establishing an annular space therebetween, said annular space extending around the water duct of said valve body.

10. A discharge nozzle as claimed in claim 9, wherein said piston includes an annular wall extending from said bearing surface and defining said water duct therein, said piston extends around and is spaced from said annular wall so as to define an intersitial space therebetween open to said annular space, and said valve body has a return duct extending therein and open to said annular space, said return duct connectable to a drain of the whirlpool tub.

11. A discharge nozzle as claimed in claim 10, wherein said spring means are two ringlike rubber cushions disposed in said annular space concentrically with respect to said water duct thereby dividing said annular space into two portions sealed from one another by said cushions, a radially outermost one of said portion in open communication with said air duct.

12. A discharge nozzle as claimed in claim 10, wherein a discharge slot is defined between said circular intervening space and said circular discharge duct by said inner surface of said disk-like distribution element and said piston, said interstitial space has a width between 0.01 and 1 mm, and said discharge slot has a width approximately twice that of said interstitial space.

13. A discharge nozzle as claimed in claim 11, wherein said disk-shaped distribution element and said valve body include one of a bayonet joint, a threaded joint, a suction joint, a plug-type connector, a magnetic lock, and a connection member that is unitary to both said valve body and said distribution element, connecting said valve body and said distribution element.

14. A discharge nozzle as claimed in claim 11, wherein said valve body includes a discharge portion in which said water duct extends, said discharge portion having a plurality of openings extending radially therethrough which re open between said water duct and said circular discharge duct.

15. A discharge nozzle as claimed in claim 11, wherein said valve body has an axial extension in which a locking groove extends, and said disk-shaped distribution element comprises flexible material extending in said locking grooves so as to be secured on said axial extension.

16. A discharge nozzle as claimed in claim 11, wherein the inner surface of said disk-shaped distribution element includes an inclined portion extending radially outwardly.

17. A discharge nozzle as claimed in claim 11, wherein a discharge slot is defined between said circular intervening space and said circular discharge duct, and said air duct is open to said circular intervening space immediately adjacent said discharge slot.

18. A discharge nozzle as claimed in claim 1, wherein the portion of the inner surface of said disk-shaped distribution element that defines said circular intervening space is inclined away from said piston in a radially outward direction.

19. A discharge nozzle as claimed in claim 41, wherein said circular discharge duct narrows in a radially outward direction so as to define a venturi at a location between said discharge duct and said circular intervening space.

20. A discharge nozzle as claimed in claim 1, wherein the outer surface of said piston is inclined away from said disk-shaped distribution element in a radially inward direction.

21. A discharge nozzle as claimed in claim 1, wherein a discharge slot is defined between said circular intervening space and said circular discharge duct, the width of said discharge slot being less than the depth of said circular intervening space.

22. A discharge nozzle as claimed in claim 1, and further comprising means for causing water and/or air passing through said water duct and/or said air duct to be intermittently discharged therefrom in a pulsating manner.

23. A discharge nozzle as claimed in claim 22 wherein said means includes said piston.

* * * * *